US007862307B2

(12) United States Patent
Watanabe et al.

(10) Patent No.: US 7,862,307 B2
(45) Date of Patent: Jan. 4, 2011

(54) SWASH PLATE COMPRESSOR

(75) Inventors: Satoshi Watanabe, Saitama (JP); Minoru Kanaizuka, Saitama (JP); Yasunori Fujita, Saitama (JP); Ryosuke Izawa, Saitama (JP); Toshiaki Kuribara, Saitama (JP)

(73) Assignee: Zexel Valeo Climate Control Corporation, Saitama (JP)

( * ) Notice: Subject to any disclaimer, the term of this patent is extended or adjusted under 35 U.S.C. 154(b) by 1005 days.

(21) Appl. No.: 10/553,478

(22) PCT Filed: Nov. 17, 2003

(86) PCT No.: PCT/JP03/14567

§ 371 (c)(1),
(2), (4) Date: Oct. 17, 2005

(87) PCT Pub. No.: WO2004/092584

PCT Pub. Date: Oct. 28, 2004

(65) Prior Publication Data

US 2007/0098568 A1 May 3, 2007

(30) Foreign Application Priority Data

Apr. 17, 2003 (JP) ..... 2003-112238

(51) Int. Cl.
*F04B 1/12* (2006.01)
*F04B 27/08* (2006.01)

(52) U.S. Cl. ..... 417/269

(58) Field of Classification Search ..... 417/269, 417/222.1; 92/13, 70, 71
See application file for complete search history.

(56) References Cited

U.S. PATENT DOCUMENTS 3,749,523 A * 7/1973 Wahl, Jr. ..... 417/269

(Continued)

FOREIGN PATENT DOCUMENTS

JP 09-287562 A 11/1997

OTHER PUBLICATIONS

European Search Report, Ref. # Z1053 EP, Dec. 12, 2006 (3 pages).

(Continued)

*Primary Examiner*—Charles G Freay
*Assistant Examiner*—Alexander B Comley
(74) *Attorney, Agent, or Firm*—Rader, Fishman & Grauer PLLC

(57) ABSTRACT

At a housing, a first gas passage I and a second gas passage II extending along the axial direction, a third gas passage III formed substantially symmetrical to the first gas passage I relative to a plane containing a drive shaft, a fourth gas passage IV formed substantially symmetrical to the second gas passage II and communicating with the second gas passage II and an external component that includes an intake port and an outlet port are disposed. Either the first gas passage or the third gas passage is made to communicate with the intake port to supply a working fluid to a front-side intake chamber and a rear-side intake chamber, and either the second gas passage or the fourth gas passage is made to communicate with a front-side outlet chamber and a rear-side outlet chamber with the gas passage not in communication with the outlet chambers made to communicate with the outlet port. The specific shapes assumed by the gas passages inside the compressor raise the level of freedom with regard to the positions at which the intake port and the outlet port may be formed in a swash plate compressor.

8 Claims, 13 Drawing Sheets

U.S. PATENT DOCUMENTS 4,101,250 A * 7/1978 Nakayama et al. ..... 417/269
4,326,838 A * 4/1982 Kawashima et al. ..... 417/269
4,407,638 A * 10/1983 Sasaya et al. ..... 417/269
4,431,378 A * 2/1984 Hattori et al. ..... 417/269
4,544,332 A 10/1985 Shibuya
4,583,922 A 4/1986 Iijima et al.
5,051,069 A * 9/1991 Ikeda et al. ..... 417/269
5,139,392 A 8/1992 Pettitt et al.
5,549,453 A * 8/1996 Murakami et al. ..... 417/269
5,580,224 A * 12/1996 Ikeda et al. ..... 417/269
5,607,287 A * 3/1997 Ikeda et al. ..... 417/269
5,636,974 A * 6/1997 Ikeda et al. ..... 417/269
5,674,054 A * 10/1997 Ota et al. ..... 417/269
5,782,613 A * 7/1998 Michiyuki et al. ..... 417/269
5,800,147 A 9/1998 Arai et al.
5,820,355 A * 10/1998 Ikeda et al. ..... 417/269
5,947,698 A * 9/1999 Ikeda et al. ..... 417/269
5,997,257 A * 12/1999 Ishida et al. ..... 417/269
6,077,049 A * 6/2000 Nakamura et al. ..... 417/269
6,293,763 B1 * 9/2001 Yokomachi et al. ..... 417/269
6,293,768 B1 * 9/2001 Shintoku et al. ..... 417/312
6,402,483 B1 * 6/2002 Kawamura et al. ..... 417/269
7,172,393 B2 * 2/2007 Adams et al. ..... 417/222.1
2001/0014289 A1 * 8/2001 Murakami et al. ..... 417/269

OTHER PUBLICATIONS

International Search Report mailed on Mar. 2, 2004.

* cited by examiner (A-A)
(B-B)
(Y-Y)
(Z-Z)
A
B
I
II
III
IV
α
β
2
4
6
8
12
16a
16b
17b
18a
18b
29a
29b
30a
30b
39a
39b
40a
40b
48a
48b
49a
49b
69

SWASH PLATE COMPRESSOR

CROSS-REFERENCE TO RELATED APPLICATIONS

This application is the U.S. National Phase Application, under 35 USC 371 of International Application PCT/JP2003/014567, filed on Nov. 17, 2003, published as WO 2004/092584 A1 on Oct. 28, 2004, and claiming priority to JP 2003-112238, filed Apr. 17, 2003, the disclosures of all of which are incorporated herein by reference.

TECHNICAL FIELD

The present invention relates to a swash plate compressor ideal in applications in which a working fluid such as a coolant gas is compressed and more specifically, it relates to a swash plate compressor assuring a higher level of freedom in the layout of the outlet port and the intake port.

BACKGROUND ART

Double-ended swash plate compressors capable of achieving large capacity and high efficiency with a simple structure are considered to be a highly viable option in applications such as automotive air-conditioning systems, and the specific structures proposed for double-ended swash plate compressors in the related art include that disclosed in Patent Publication No. 3266504 (see paragraphs 0020 to 0028, FIGS. 1, 2, 5 and 6).

This compressor includes a cylinder block having formed therein a swash plate chamber in which a swash plate is housed and a plurality of cylinders, pistons that move reciprocally inside the cylinders, a front-side cylinder head fixed to one end of the cylinder block via a valve plate and a rear-side cylinder head fixed to another end of the cylinder block via a valve plate. At each cylinder head, an intake chamber in which the working fluid to be guided into the cylinders is stored and an outlet chamber in which the working fluid having been compressed at compression spaces is stored are formed, and the compressor further includes an intake passage communicating between an intake port formed at a cylinder head and the swash plate chamber, a relay passage that communicates between the swash plate chamber and the intake chambers, an outlet passage formed at the cylinder block, which communicates with the front-side outlet chamber and the rear-side outlet chamber, an outlet passage formed at the cylinder block, which communicates with an outlet port formed at one of the cylinder heads and a guide passage that communicates between the outlet passages at a middle area thereof.

In the structure described above, the working fluid having flowed in through the intake port is guided to the swash plate chamber via the intake passage and then is guided into the intake chambers at the cylinder head via the relay passage. After it is compressed at the compression spaces, the working fluid is delivered into the outlet chambers, and then is made to flow out through the outlet port via the outlet passages and the guide passage.

However, the external component at which the intake port and the outlet port are disposed may need to be mounted at the cylinder block instead of a cylinder head, depending upon the compressor installation location, the piping layout or the like. If the design of the gas passages inside the compressor is to be completely modified each time the position of the ports needs to be altered, the design of the individual components constituting the gas passages, too, will have to be reviewed, which means that these components cannot be provided as universal components and that the advantages of mass production are not gained.

Accordingly, an intake gas passage and an outlet gas passage may be formed in advance at the housing and the external component having disposed thereat the intake port and the outlet port alone may be redesigned in correspondence to the positions at which the ports need to be located. However, this solution may lead to further problems in that the positions of the ports and the positions of the gas passages can be greatly misaligned depending upon the layout of the piping connected to the compressor, necessitating the gas passages formed within the cylinder heads to adopt complicated shapes and that the passages extending from the ports to the gas passages can become unnecessarily long, to result in lowered compressor performance, an increase in the number of machining steps and a more complex casting process.

A primary object of the present invention, which has been completed by addressing the problems of the related art discussed above, is to provide a swash plate compressor adopting a specific structure for the gas passages formed in the compressor to solve the problems described above and afford a higher level of freedom with regard to the port positions so as to achieve better versatility is supporting various compressor models assuming different port positions.

DISCLOSURE OF THE INVENTION

In order to achieve the object described above, the swash plate compressor according to the present invention, comprising a housing that includes cylinders formed therein, a drive shaft rotatably supported at the housing, a swash plate that is housed inside a swash plate chamber formed at the housing and rotates as one with the drive shaft and pistons that slide reciprocally inside the cylinders as the swash plate rotates, which is characterized in that a front-side intake chamber and a rear-side intake chamber disposed to the front and to the rear of the swash plate chamber along the axial direction, in which a working fluid to be guided into the cylinders is stored, a front-side outlet chamber and a rear-side outlet chamber disposed to the front and to the rear of the swash plate chamber along the axial direction, in which the working fluid having been compressed by the piston is stored, a first gas passage and a second gas passage extending along the axial direction, a third gas passage formed substantially symmetrical to the first gas passage relative to a plane containing the drive shaft, a fourth gas passage formed substantially symmetrical with the second gas passage relative to a plane containing the drive shaft and communicating with the second gas passage and an external component having an intake port and an outlet port to be connected to pipings, are all disposed at the housing, that either the first gas passage or the third gas passage is made to communicate with the intake port to supply the working fluid into the front-side intake chamber and the rear-side intake chamber and that either the second gas passage or the fourth gas passage is made to communicate with the front-side outlet chamber and the rear-side outlet chamber and the second gas passage or the fourth gas passage, which is not in communication with the outlet chambers, is made to communicate with the outlet port.

The housing that includes the third gas passage formed substantially symmetrical to the first gas passage and the fourth gas passage formed substantially symmetrical to the second gas passage relative to the plane containing the drive shaft in addition to the first and second gas passages extending along the axial direction can be used as a universal housing, without having to modify the layout of the group of gas passages at the housing even when the intake port and the outlet port are formed at different positions. Thus, common components can be used to form the gas passages, and also, since the intake port or the outlet port can be formed in conjunction with the shortest gas passage, the gas passages inside the housing do not need to be bent in complex shapes or the passages extending from the port to the gas passages does not need to be unnecessarily long.

The structure described above, which allows the first gas passage or the third gas passage to communicate with the intake port and the second gas passage or the fourth gas passage to communicate with the outlet port depending upon the specific positions of the intake port and the outlet port, can be adopted in conjunction with various port positions.

In addition, the structure described above is particularly effective in a swash plate compressor having the first gas passage and the third gas passage made to communicate with the swash plate chamber and further having formed at the housing a front-side relay gas passage and a rear-side relay gas passage that communicate between the swash plate chamber and the front-side intake chamber and between the swash plate chamber and the rear-side intake chamber.

If the housing includes a cylinder block having formed therein cylinders, valve plates each having formed therein an intake hole and an outlet hole in correspondence to each cylinder and cylinder heads fixed to the cylinder block via the valve plates, which form intake chambers that are allowed to communicate with the intake holes and outlet chambers that are allowed to communicate with the outlet holes, the valve plates, valve sheets having intake valves provided between the cylinder block and the valve plates, the cylinder heads and the cylinder block may constitute part of the components used to form the first through fourth gas passages. In addition, it is desirable that at least one of the components used to form the first through fourth gas passages be shared on the front-side and the rear-side.

Figure 2A:
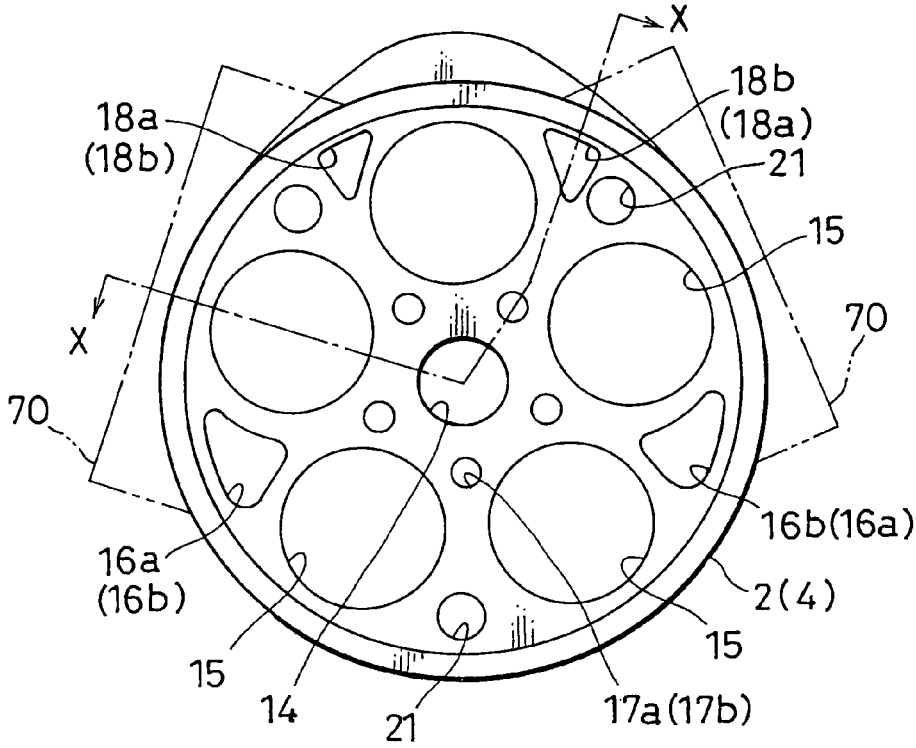
FIG. 2 shows a cylinder block constituting the swash plate compressor in FIG. 1, with FIG. 2(*a*) presenting a view of the cylinder block from the cylinder head side and FIG. 2(*b*) presenting a view of the cylinder block from the side on which the other cylinder block is present.
Figure 2B:
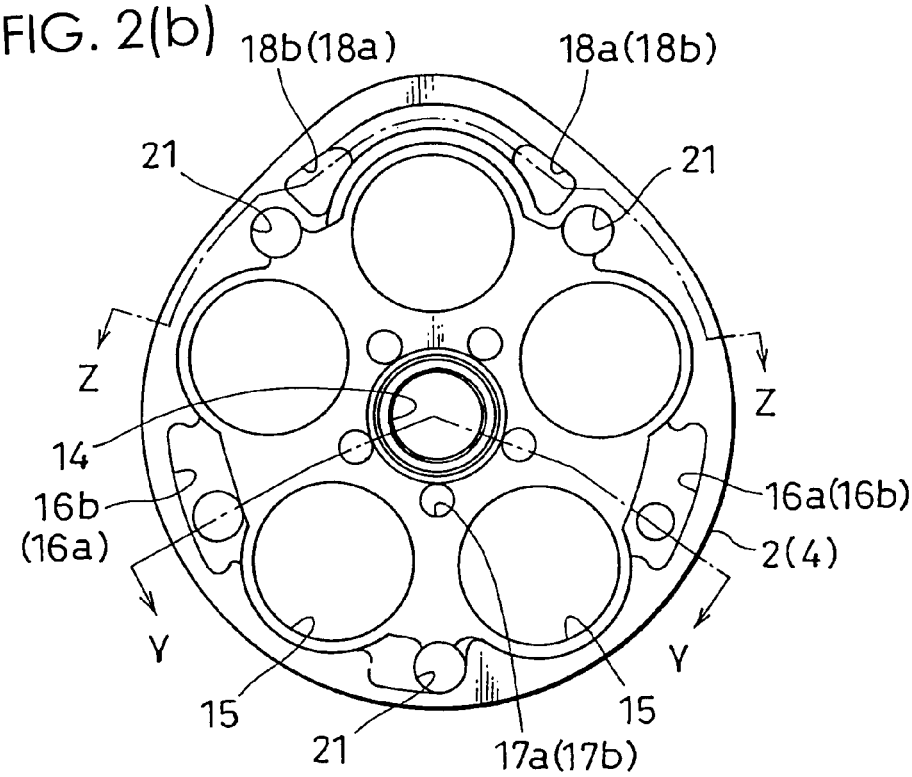
Figure 5:
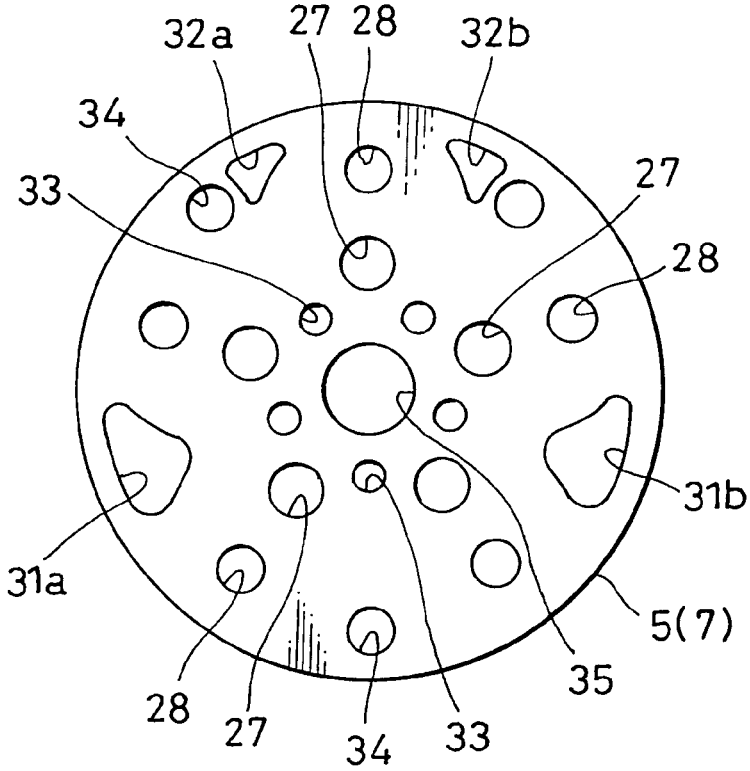
Figure 6:
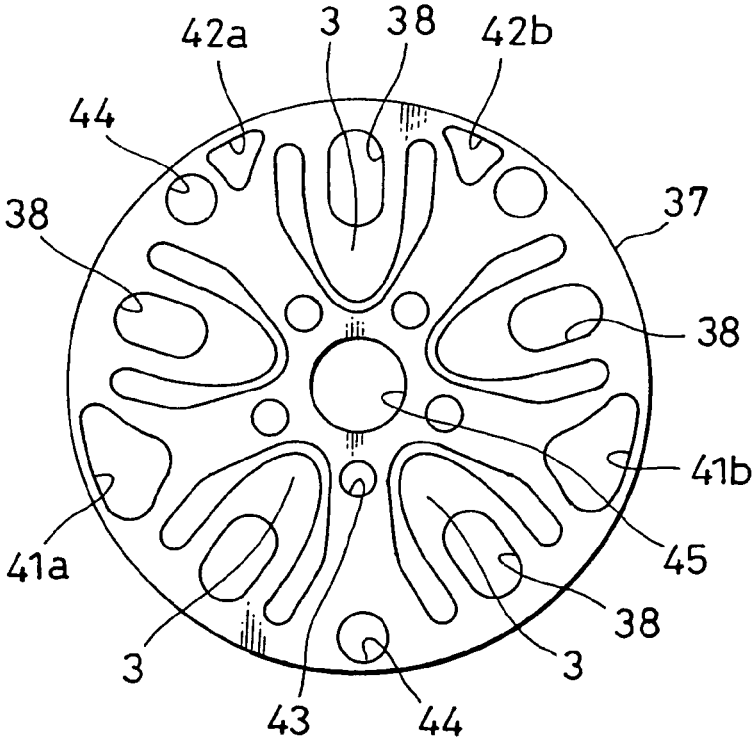
Figure 7:
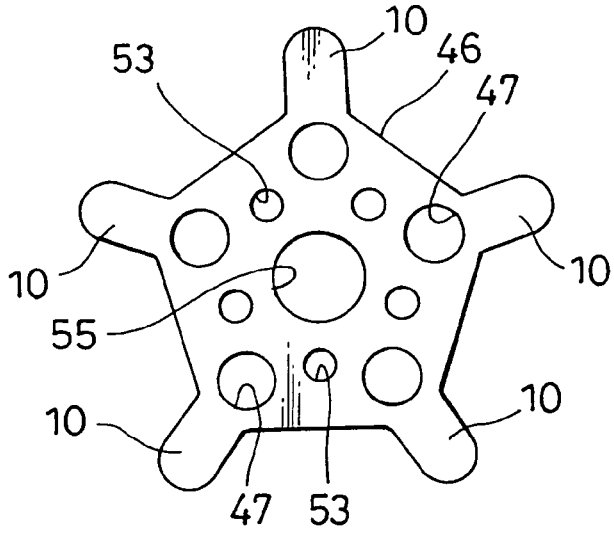
Figure 8:
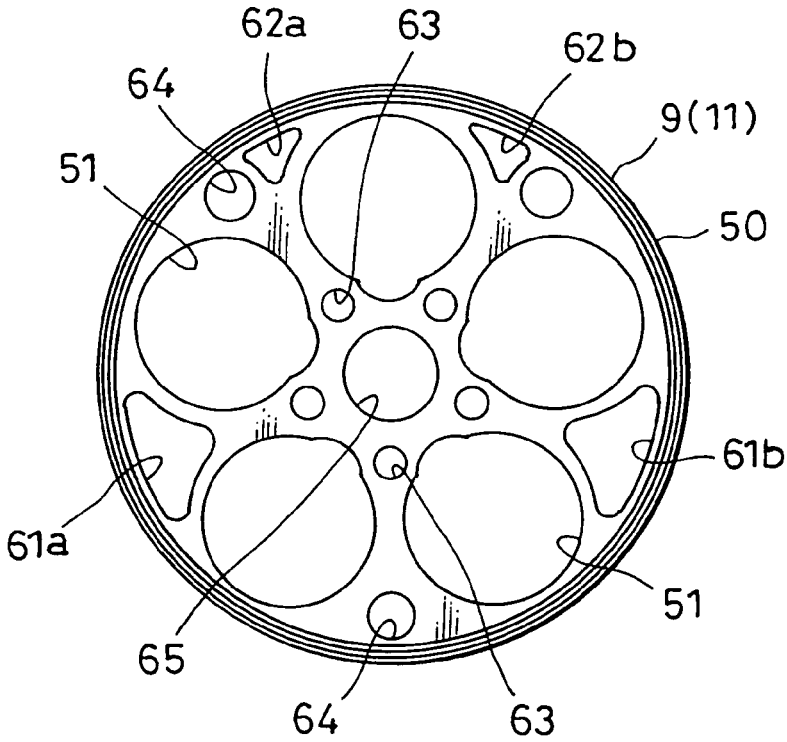
Figure 9A:
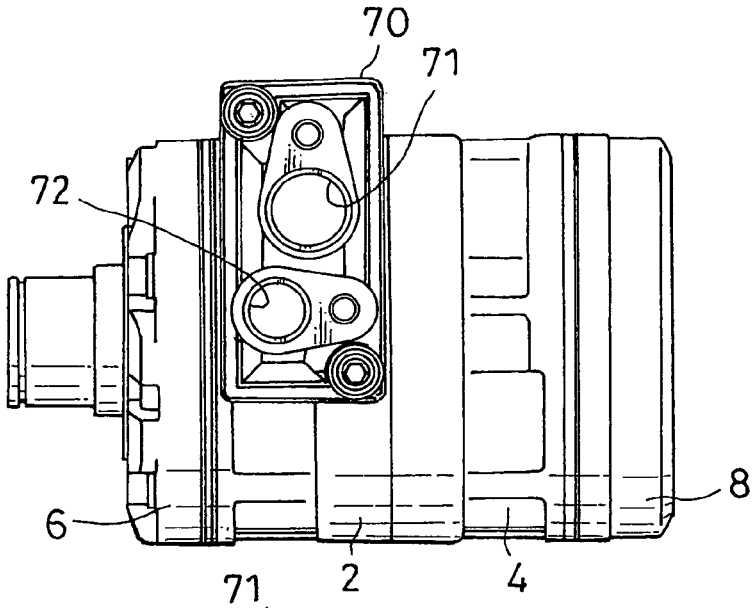
Figure 9B:
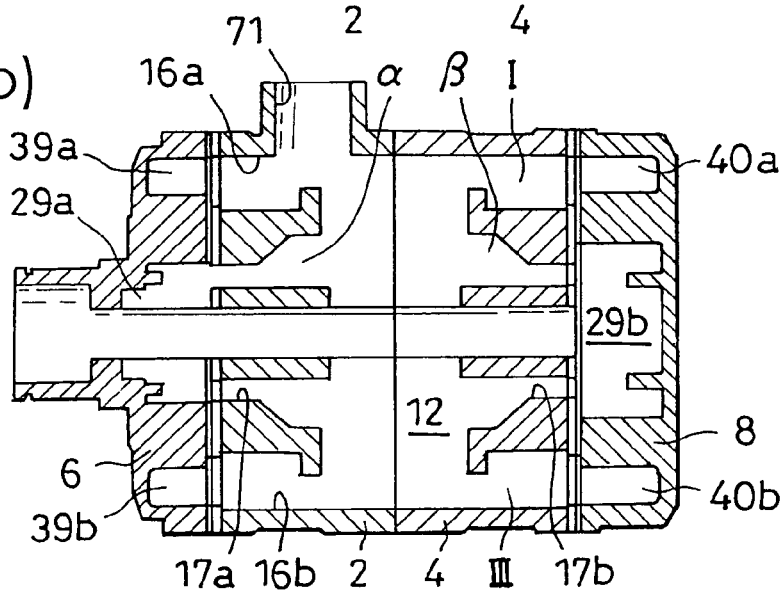
Figure 9C:
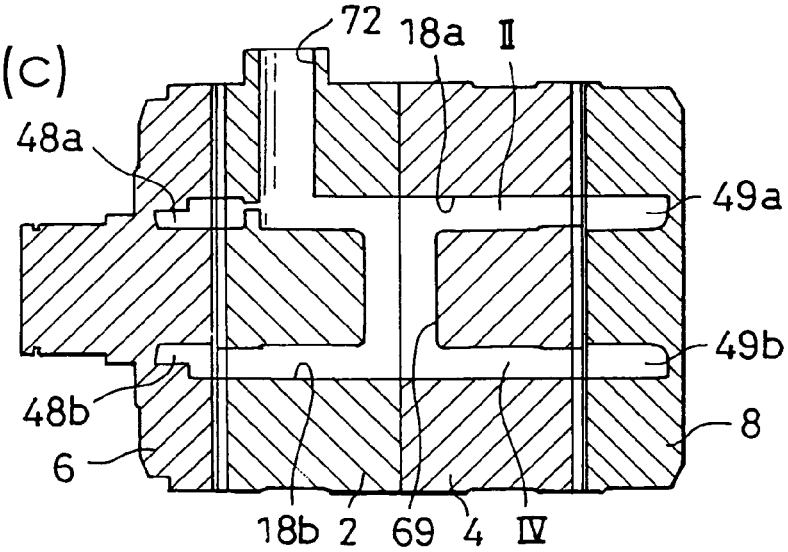
Figure 10A:
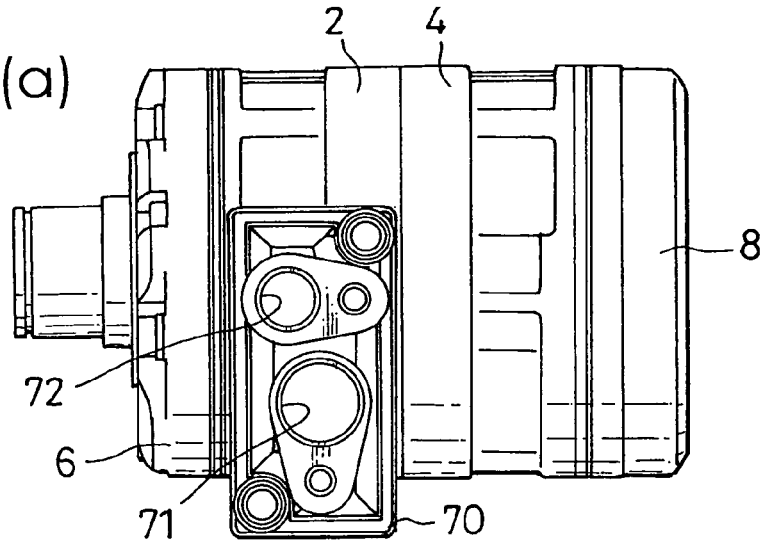
Figure 10B:
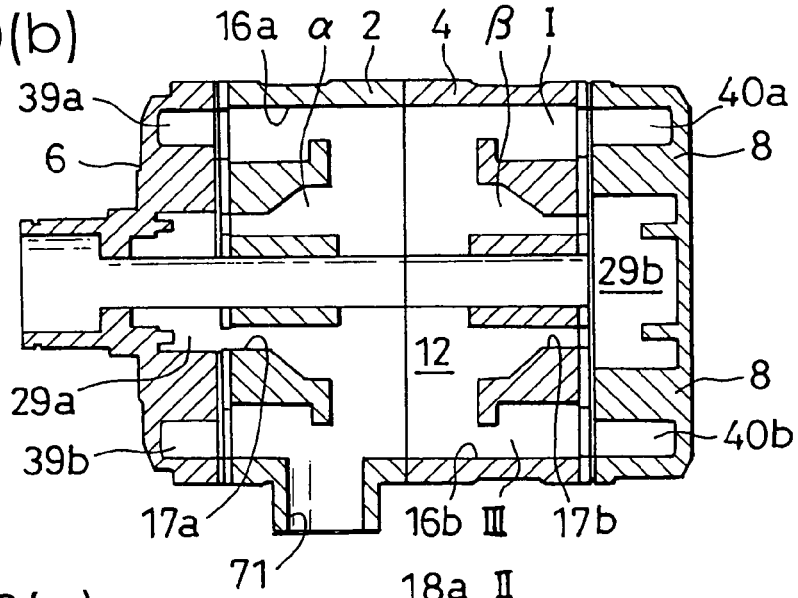
Figure 10C:
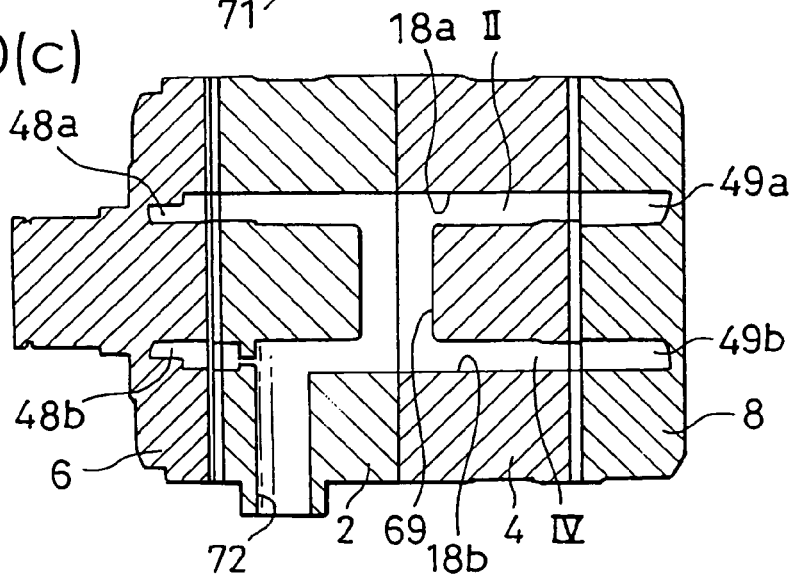
Figure 11A:
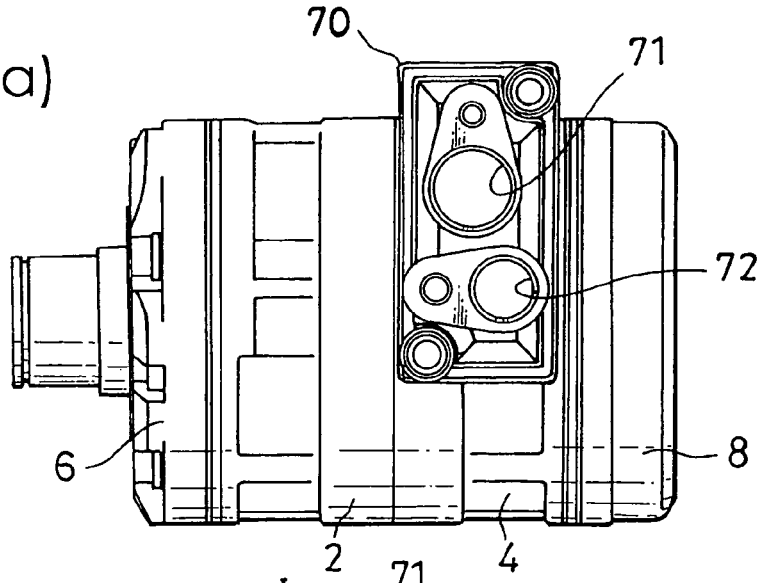
Figure 11B:
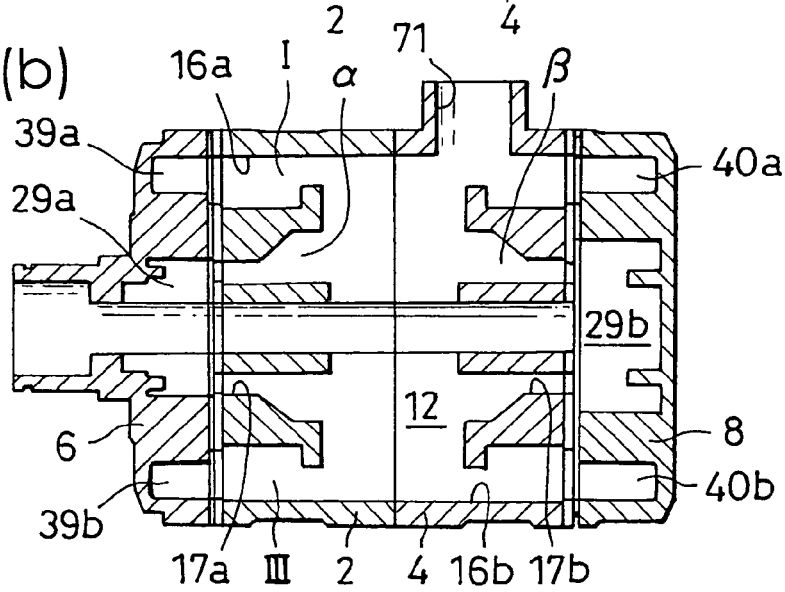
Figure 11C:
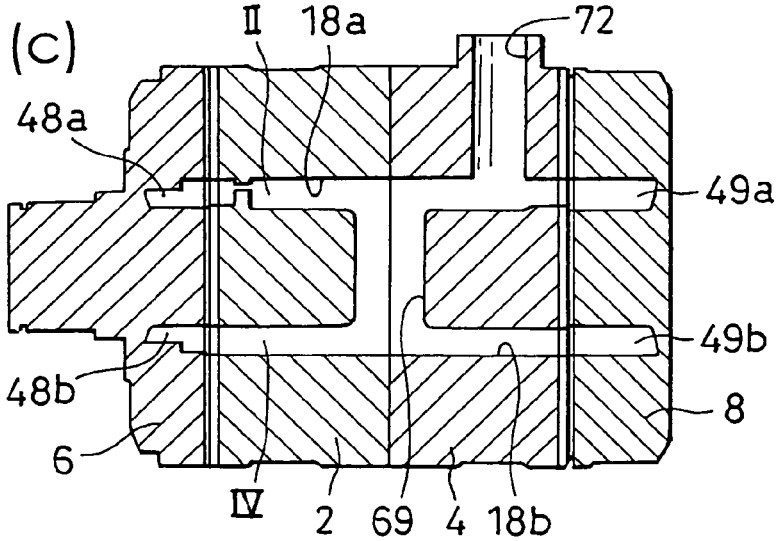
Figure 12A:
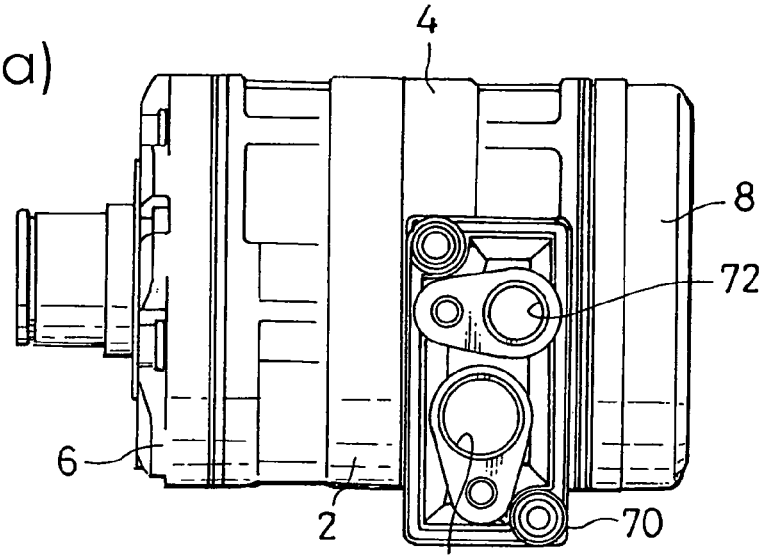
Figure 12B:
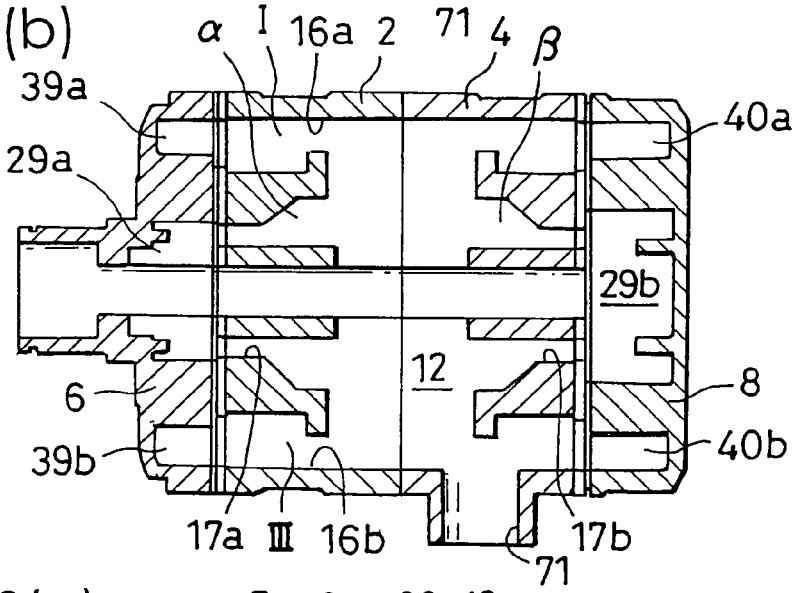
Figure 12C:
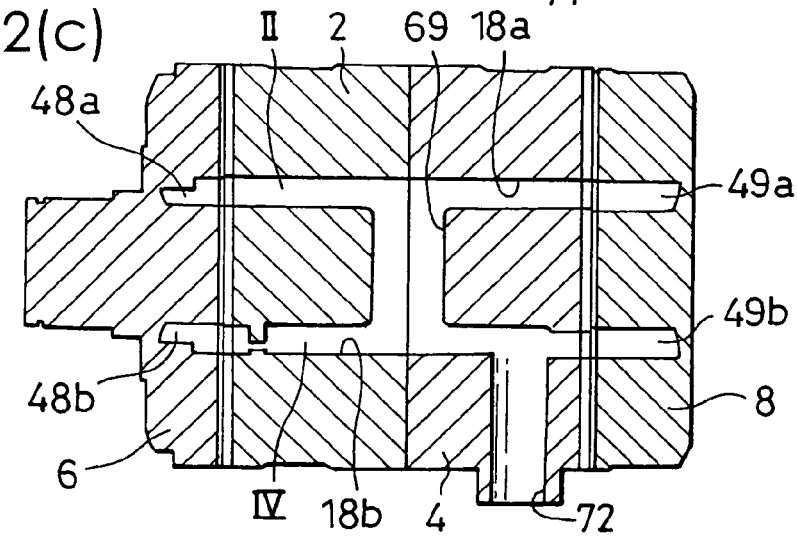
Figure 13A:
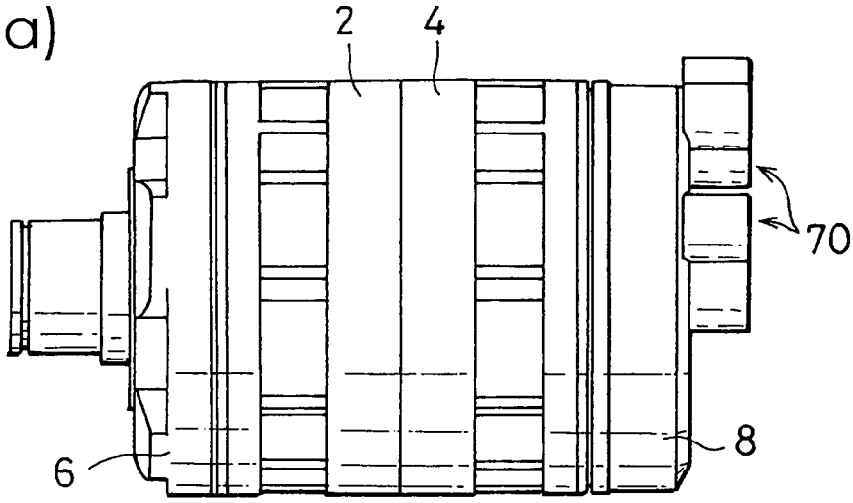
Figure 13B:
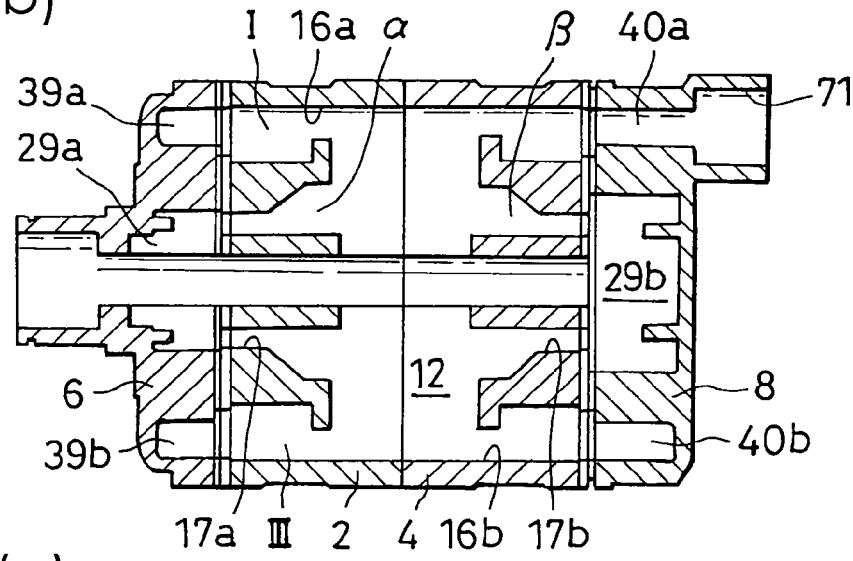
Figure 13C:
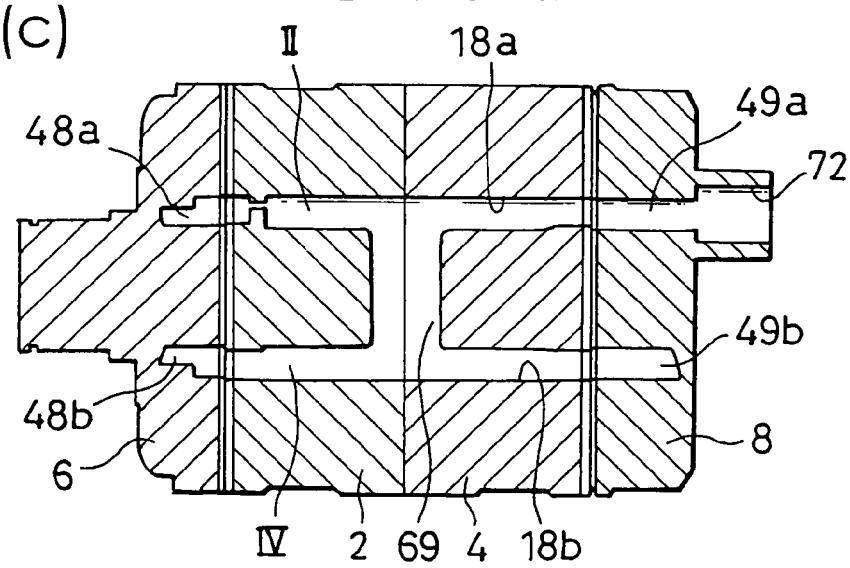
Figure 14:
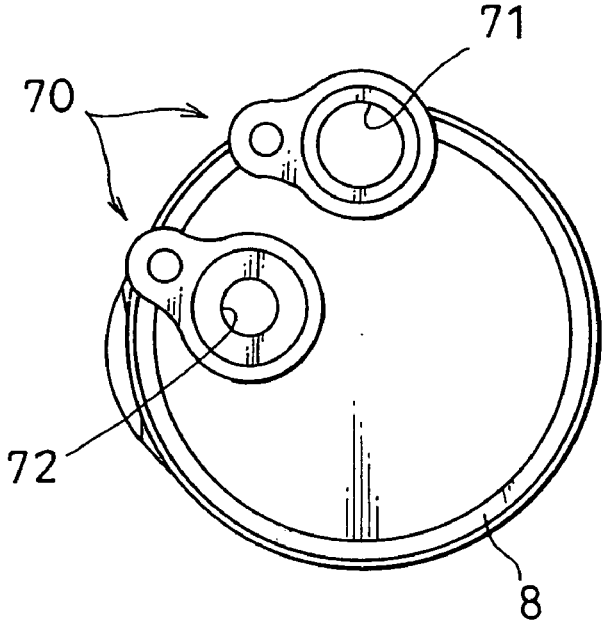
Figure 16:
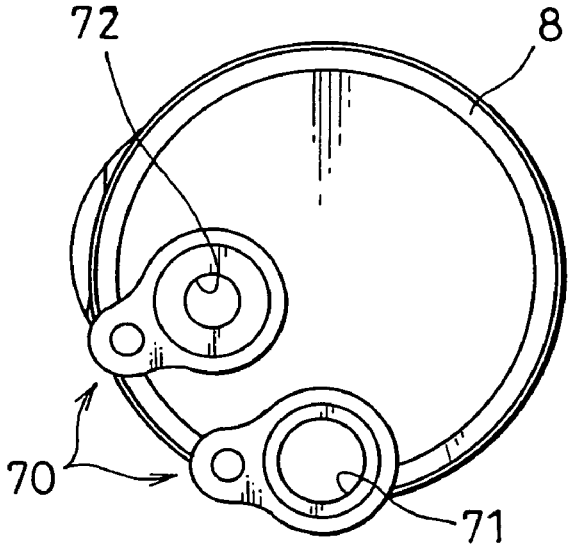
Figure 15A:
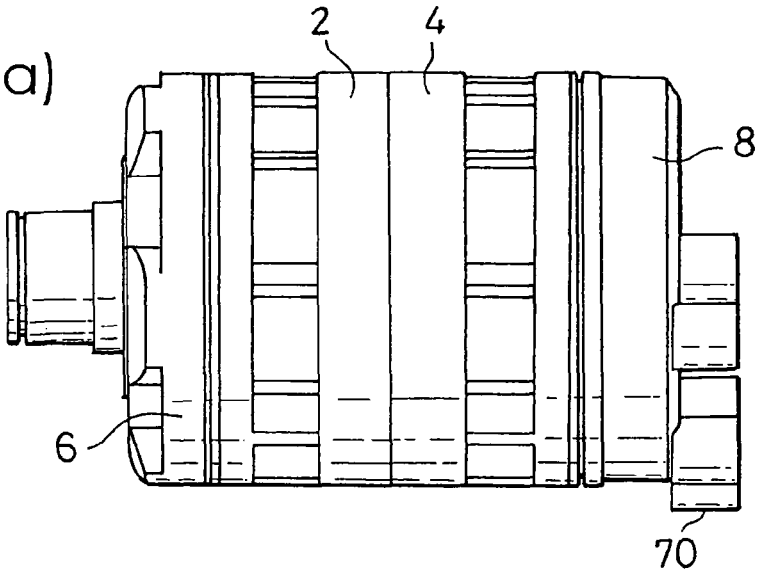
Figure 15B:
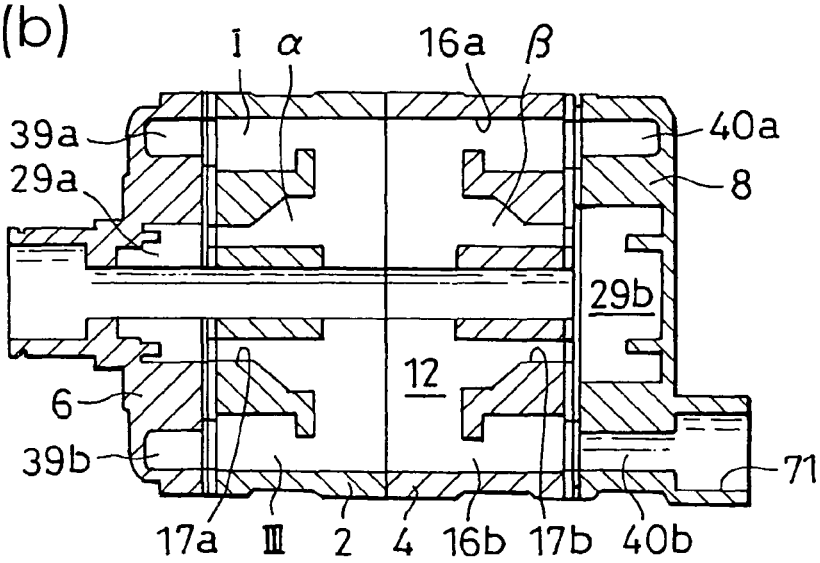
Figure 15C:
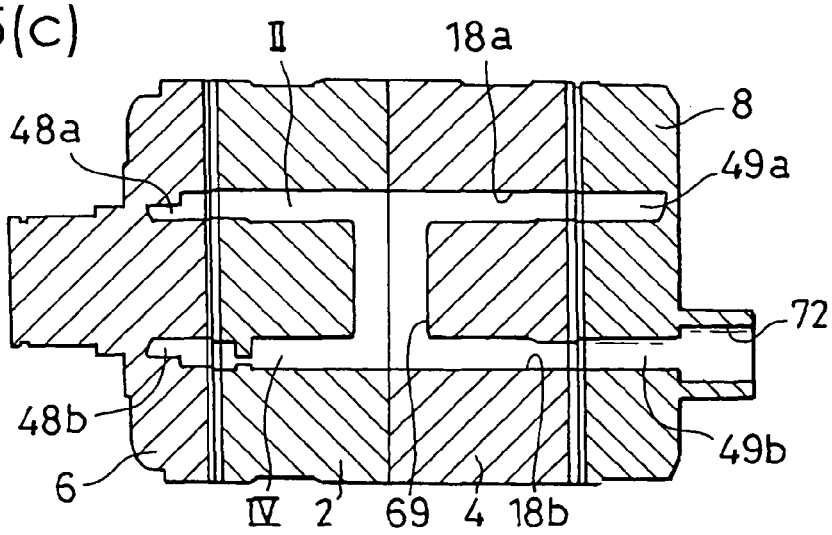

a FIG. 5 is a front view of a valve plate;

FIG. 6 shows the intake valves and a valve sheet at which the intake valves are formed;

FIG. 7 shows the outlet valves and a valve sheet at which the outlet valves are formed;

FIG. 8 shows a gasket;

FIG. 9 presents a structural example having the intake port and the outlet port disposed on one side surface of the front-side cylinder block, with FIG. 9(*a*) presenting a side elevation showing an external view of the compressor, FIG. 9(*b*) showing the intake path in the compressor in a sectional view equivalent to that taken along line Y-Y in FIG. 2(*b*) and FIG. 9(*c*) showing the outlet path in the compressor in a sectional view equivalent to that taken along line Z-Z in FIG. 2(*b*);

FIG. 10 presents a structural example having the intake port and the outlet port disposed on the other side surface of the front-side cylinder block, with FIG. 10(*a*) presenting a side elevation showing an external view of the compressor, FIG. 10(*b*) showing the intake path in the compressor in a sectional view equivalent to that taken along line Y-Y in FIG. 2(*b*) and FIG. 10(*c*) showing the outlet path in the compressor in a sectional view equivalent to that taken along line Z-Z in FIG. 2(*b*);

FIG. 11 presents a structural example having the intake port and the outlet port disposed on one side surface of the rear-side cylinder block, with FIG. 11(*a*) presenting a side elevation showing an external view of the compressor, FIG. 11(*b*) showing the intake path in the compressor in a sectional view equivalent to that taken along line Y-Y in FIG. 2(*b*) and FIG. 11(*c*) showing the outlet path in the compressor in a sectional view equivalent to that taken along line Z-Z in FIG. 2(*b*);

FIG. 12 presents a structural example having the intake port and the outlet port disposed on the other side surface of the rear-side cylinder block, with FIG. 12(*a*) presenting a side elevation showing an external view of the compressor, FIG. 12(*b*) showing the intake path in the compressor in a sectional view equivalent to that taken along line Y-Y in FIG. 2(*b*) and FIG. 12(*c*) showing the outlet path in the compressor in a sectional view equivalent to that taken along line Z-Z in FIG. 2(*b*);

FIG. 13 presents a structural example having the intake port and the outlet port disposed on one side at the end surface of the rear-side cylinder head, with FIG. 13(*a*) presenting a side elevation showing an external view of the compressor, FIG. 13(*b*) showing the intake path in the compressor in a sectional view equivalent to that taken along line Y-Y in FIG. 2(*b*) and FIG. 13(*c*) showing the outlet path in the compressor in a sectional view equivalent to that taken along line Z-Z in FIG. 2(*b*);

FIG. 14 shows the compressor in FIG. 13 viewed along the axial direction from the rear-side;

FIG. 15 presents a structural example having the intake port and the outlet port disposed on the other side at the end surface of the rear-side cylinder head, with FIG. 15(*a*) presenting a side elevation showing an external view of the compressor, FIG. 15(*b*) showing the intake path in the compressor in a sectional view equivalent to that taken along line Y-Y in FIG. 2(*b*) and FIG. 15(*c*) showing the outlet path in the compressor in a sectional view equivalent to that taken along line Z-Z in FIG. 2(*b*); and FIG. 16 shows the compressor in FIG. 15 viewed along the axial direction from the rear-side.

BEST MODE FOR CARRYING OUT THE INVENTION

Figure 1:
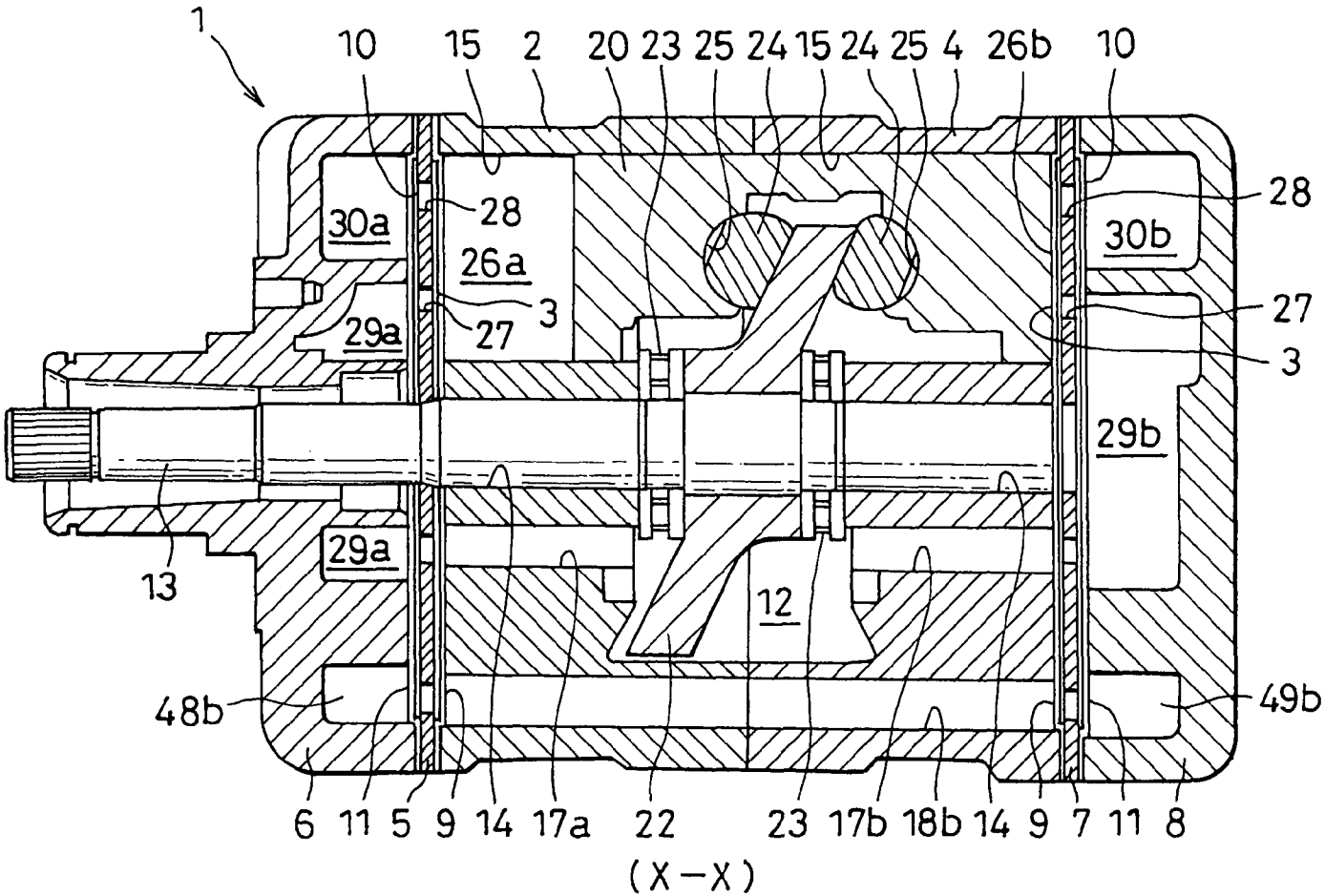
FIG. 1 is a sectional view of a swash plate compressor according to the present invention, taken along line X-X in FIG. 2(*a*)

The following is an explanation of an embodiment of the present invention, given in reference to the drawings. A swash plate compressor 1 in FIGS. 1 through 3, intended for use in a refrigerating cycle in which a coolant is used as a working fluid, comprises a front-side cylinder block 2, a rear-side cylinder block 4 attached to the front-side cylinder block 2 via a gasket or an O-ring (not shown) or directly without disposing any seal member in between, a front-side cylinder head 6 attached to the front-side (the left side in the figures.) of the front-side cylinder block 2 via a valve plate 5 and a rear-side cylinder head 8 attached to the rear-side (the right side in the figures.) of the rear-side cylinder block 4 via a valve plate 7.

The front-side cylinder head 6, the valve plate 5, the front-side cylinder block 2, the rear-side cylinder block 4, the valve plate 7 and the rear-side cylinder head 8 are fastened together along the axial direction with fastening bolts (not shown) so as to constitute the housing for the entire compressor.

Figure 4:
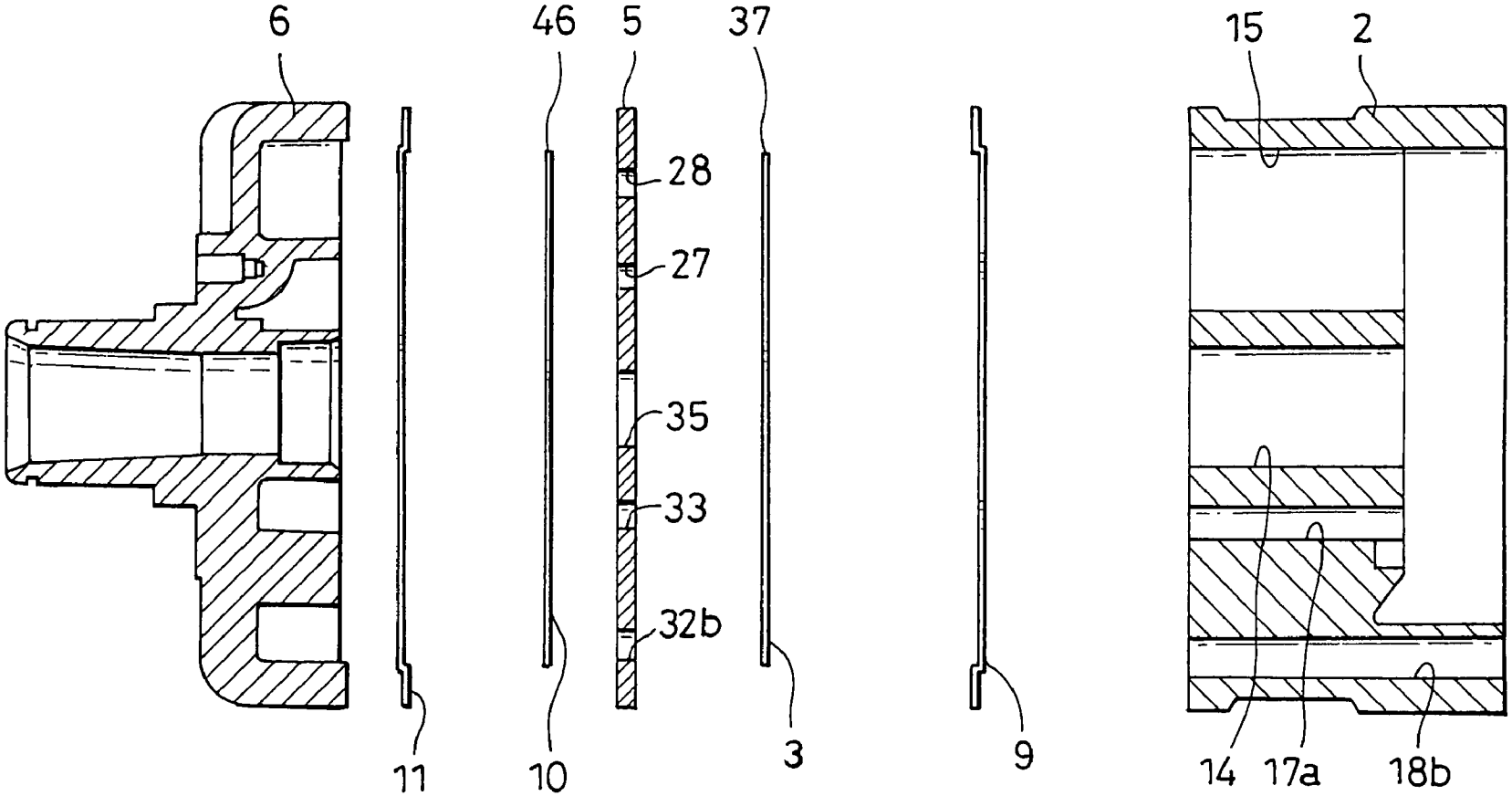
FIG. 4 shows how the valve plate, the intake valve, the outlet valve and the gasket are disposed between the front-side cylinder block and the front-side cylinder head.

As shown in FIG. 4, intake valves 3 facing opposite the valve plates 5 and 7 are disposed respectively between the cylinder block 2 and the valve plate 5 and between the cylinder block 4 and the valve plate 7, with gaskets 9 disposed so as to face opposite both the intake valves 3 and the cylinder blocks 2 and 4. In addition, outlet valves 10 facing opposite the valve plates 5 and 7 are disposed respectively between the cylinder head 6 and the valve plate 5 and between the cylinder head 8 and the valve plate 7, with gaskets 11 disposed so as to face opposite both the outlet valves 10 and the cylinder heads 6 and 8.

Inside the front-side cylinder block 2 and the rear-side cylinder block 4, a swash plate chamber 12 is formed as the individual cylinder blocks 2 and 4 are assembled with each other, and a drive shaft 13, which is inserted at the front-side cylinder block 2 and the rear-side cylinder block 4, with one end thereof projecting out beyond the cylinder head 6 on the front-side to be locked onto the armature of an electromagnetic clutch (not shown), is disposed in the swash plate chamber 12.

In addition, at the cylinder blocks 2 and 4, a shaft support hole 14 that rotatably supports the drive shaft 13, a plurality of (e.g., 5) cylinders 15 extending parallel to the shaft support hole 14 and disposed over equal intervals on the circumference of a circle centered around the drive shaft 13, two intake passages 16*a* and 16*b* (only one of the intake passages is used during operation) communicating with the swash plate chamber 12 over the areas near the circumferential edges and extending along the drive shaft 13 in the axial direction, a plurality of relay passages 17*a* or 17*b* disposed over equal intervals on the circumference of a circle near the shaft support hole 14, communicating with the swash plate chamber 12 and extending along the drive shaft 13 in the axial direction and two outlet passages 18*a* and 18*b* separated from the swash plate chamber 12 and extending along the drive shaft 13 are formed.

In this embodiment, in which five cylinders are disposed over equal intervals, the intake passages 16*a* and 16*b* are formed between the second and third cylinders and between the fourth and fifth cylinders along the circumferential direction with a given cylinder designated as the origin point, whereas the outlet passages 18*a* and 18*b* are formed between the first and second cylinders and between the fifth and first cylinders. Thus, the intake passages 16*a* and 16*b* are formed substantially symmetrical to each other and the outlet passages 18*a* and 18*b* are formed substantially symmetrical to each other relative to a single plane containing the drive shaft (a plane containing the drive shaft and ranging in the upward/downward direction in FIG. 2) in this structural example. Inside each cylinder 15, a double-ended piston 20 is slidably inserted. It is to be noted that reference numeral 21 in the figures indicate bolt insertion holes formed between the cylinders 15, at which the fastening bolts are inserted.

Inside the swash plate chamber 12, a swash plate 22, which rotates as one with the drive shaft 13, is fixed onto the drive shaft 13. The swash plate 22 rotatably supported at the front-side cylinder block 2 and the rear-side cylinder block 4 by thrust bearings 23, is held at a shoe pocket 25 formed at the center of the double-ended pistons 20 via a pair of shoes 24 assuming a semispherical shape, disposed so as to sandwich the edge of the swash plate 22 from the front and the rear. Thus, as the drive shaft 13 rotates causing the swash plate 22 to rotate, the rotational motion is converted to a reciprocal linear movement of the double-ended pistons 20 via the shoes 24 and the reciprocal movement of the double-ended pistons 20, in turn, varies the volumetric capacities at compression spaces 26*a* and 26*b* respectively formed between the pistons 20 and the valve plate 5 and between the pistons 20 and the valve plate 7 inside the cylinder 15.

The valve plates 5 and 7 are formed in an identical shape and at each valve plate an intake hole 27 and an outlet hole 28 are formed in correspondence to each cylinder 15, passing holes 31*a* and 31*b* are formed in correspondence to the intake passages 16*a* and 16*b*, passing holes 32*a* and 32*b* are formed in correspondence to the outlet passages 18*a* and 18*b*, passing holes 33 are formed each in correspondence to one of the relay passages 17*a* and 17*b*, passing holes 34 are formed in correspondence to one of the bolt insertion holes 21 and a passing hole 35 is formed in correspondence to the shaft support hole 14.

In addition, to the front and to the rear of the swash plate chamber 12 at the housing, i.e., at the front-side and the rear-side cylinder heads 6 and 8, a front-side intake chamber 29*a* and a rear-side compression chamber 29*b*, in which the working fluid to be supplied into the compression spaces 26*a* and 26*b* is stored and a front-side outlet chamber 30*a* and a rear-side outlet chamber 30*b* in which the working fluid having been compressed by the pistons and let out from the compression spaces 26*a* and 26*b* is stored are formed. At the cylinder head 6, auxiliary chambers 39*a* and 39*b* which do not communicate with the outlet chamber 30*a* are formed in correspondence to the intake passages 16*a* and 16*b* respectively and relay chambers 48*a* and 48*b* are formed in correspondence to the outlet passages 18*a* and 18*b* respectively so as to achieve communication with the outlet chamber 30*a*. Likewise, at the cylinder head 8, auxiliary chambers 40*a* and 40*b*, which do not communicate with the outlet chamber 30*b* are formed in correspondence to the intake passages 16*a* and 16*b* respectively and relay chambers 49*a* and 49*b* are formed in correspondence to the outlet passages 18*a* and 18*b* respectively so as to achieve communication with the outlet chamber 30*b*.

The intake chambers 29*a* and 29*b* are allowed to communicate with the compression spaces 26*a* and 26*b* via the intake holes 27 formed at the valve plates 5 and 7, whereas the outlet chambers 30*a* and 30*b* are respectively formed continuously around the intake chambers 29*a* and 29*b* and are allowed to communicate with the compression spaces 26*a* and 26*b* via the outlet holes 28 formed at the valve plates 5 and 7. In addition, the individual auxiliary chambers 39*a*, 39*b*, 40*a* and 40*b* communicate with the corresponding intake passages 16*a* and 16*b* via the passing holes 31*a* and 31*b* at the valve plates 5 and 7, valve sheets to be detailed later, at which the intake valves 3 are formed and passing holes at the gaskets. The individual relay chambers 48*a*, 48*b*, 49*a* and 49*b* communicate with the corresponding outlet passages 18*a* and 18*b* via the passing holes 32*a* and 32*b* at the valve plates 5 and 7, the valve sheets to be detailed later, at which the intake valves 3 are formed, and passing holes at the gaskets.

The intake holes 27 are each opened/closed by an intake valve 3 disposed at the end surface of the valve plate 5 or 7 toward the cylinder block, whereas the outlet holes 28 are each opened/closed by an outlet valve provided at the end surface of the valve plate 5 or 7 toward the cylinder head.

The intake valves 3, which are formed in shapes identical to one another on the front-side and the rear-side, are each formed as a tongue piece constituting an integrated part of a round valve sheet 37 by slitting the valve sheet 37 as shown in FIG. 6. At each valve sheet 37, passing holes 38, passing holes 41*a* and 41*b*, passing holes 42*a* and 42*b*, passing holes 43, passing holes 44 and a passing hole 45 are formed so as to face opposite the outlet holes 28, the passing holes 31*a* and 31*b*, the passing holes 32*a* and 32*b*, the passing holes 33, the passing holes 34 and the passing hole 35 respectively when the valve sheet 37 is placed against the valve plate 5 or 7.

In addition, the outlet valves 10 are formed in shapes identical to one another on the front-side and the rear-side and are each formed as a tongue piece, as shown in FIG. 7, by letting the circumferential edge of a valve sheet 46 project out along the radial direction. At each valve sheet 46, passing holes 47, passing holes 53 and a passing hole 55 are formed so as to face opposite the intake holes 27, the passing holes 33 and the passing hole 35 respectively when the valve sheet 46 is placed against the valve plate 5 or 7.

Thus, on an intake stroke during which the volumetric capacities of the compression spaces 26*a* and 26*b* increase as the pistons 20 move reciprocally, the working fluid is taken into the compression spaces 26*a* and 26*b* from the intake chambers 29*a* and 29*b* via the intake holes 27 and the intake valves 3, whereas on a compression stroke during which the volumetric capacities of the compression spaces 26*a* and 26*b* decrease, the working fluid being compressed at the compression spaces 26*a* and 26*b* is forced out into the outlet chambers 30*a* and 30*b* via the outlet holes 28 and the outlet valves 10.

It is to be noted that identical gaskets 9 and 11 are used on the front-side and the rear-side. The gaskets 9 are disposed between the cylinder block 2 and the valve plate 5 and between the cylinder block 4 and the valve plate 7, whereas the gaskets 11 are disposed between the cylinder head 6 and the valve plate 5 and also between the cylinder head 8 and the valve plate 7. As shown in FIG. 8, they each include a seal portion 50 formed over the entire circumferential edge thereof to be used to seal the space between the cylinder block 2 or 4 and the valve plate 5 or 7 and between the cylinder heads 6 or 8 and the valve plate 5 or 7. At each gasket, passing holes 51 are formed at positions facing opposite the intake valves 3 or the outlet valves so as to avoid contact with the valves, and passing holes 61*a* and 61*b*, passing holes 62*a* and 62*b*, passing holes 63, passing holes 64 and a passing hole 65 are respectively formed at positions facing opposite the passing holes 31*a* and 31*b* or the passing holes 41*a* and 41*b*, the passing holes 32*a* and 32*b* or the passing holes 42*a* and 42*b*, the passing holes 43 or 53, the passing holes 34 or 44 and the passing hole 45 or 55.

As a result, two gas passages, one communicating with the auxiliary chamber 39*a* at the front-side cylinder head 6 and the auxiliary chamber 40*a* at the rear-side cylinder head 8 via the intake passage 16*a* formed at the cylinder blocks 2 and 4, passing holes 61*a* formed at the gaskets 9 and 11, the passing holes 31*a* formed at the valve plates 5 and 7 and the passing holes 41*a* formed at the valve sheets 37, the other communicating with the auxiliary chamber 39*b* at the front-side cylinder head 40*b* at the rear-side cylinder head via the intake passage 16*b* formed at the cylinder blocks 2 and 4, the passing holes 61*b* formed at the gaskets 9 and 11, the passing holes 31*b* formed at the valve plates 5 and 7 and the passing holes 41 formed at the valve sheets 37 are formed to communicate with the swash plate chamber 12 at the housing. These two passages constitute a first gas passage (I) and a third gas passage (III) extending along the axis of the drive shaft 13.

In addition, a front-side relay gas passage α and a rear-side relay gas passage β are constituted respectively with the relay passages 17*a* and 17*b* formed at the individual cylinder blocks, the passing holes 63 formed at the gaskets 9 and 11, the passing holes 43 and 53 formed at the valve sheets 37 and 46 and the passing holes 33 formed at the valve plates 5 and 7, so as to communicate between the swash plate chamber 12 and the intake chambers 29*a* and 29*b* formed at the cylinder heads 6 and 8.

Also, two gas passages, one allowing communication among the outlet passage 18*a* formed at the cylinder blocks, the passing holes 62*a* formed at the gaskets 9 and 11, the passing holes 42*a* formed at the valve sheets 37 and the passing holes 32*a* formed at the valve plates 5 and 7 as necessary and the other allowing communication among the outlet passage 18*b* formed at the cylinder blocks, the passing holes 62*b* formed at the gaskets 9 and 11, the passing holes 42*b* formed at the valve sheets 37 and the passing holes 32*b* formed at the valve plates 5 and 7, are formed at the housing, and these two gas passages constitute a second gas passage (II) and a fourth gas passage (IV) extending along the axis of the drive shaft 13.

Figures 3A, 3B, 3C, 3D:
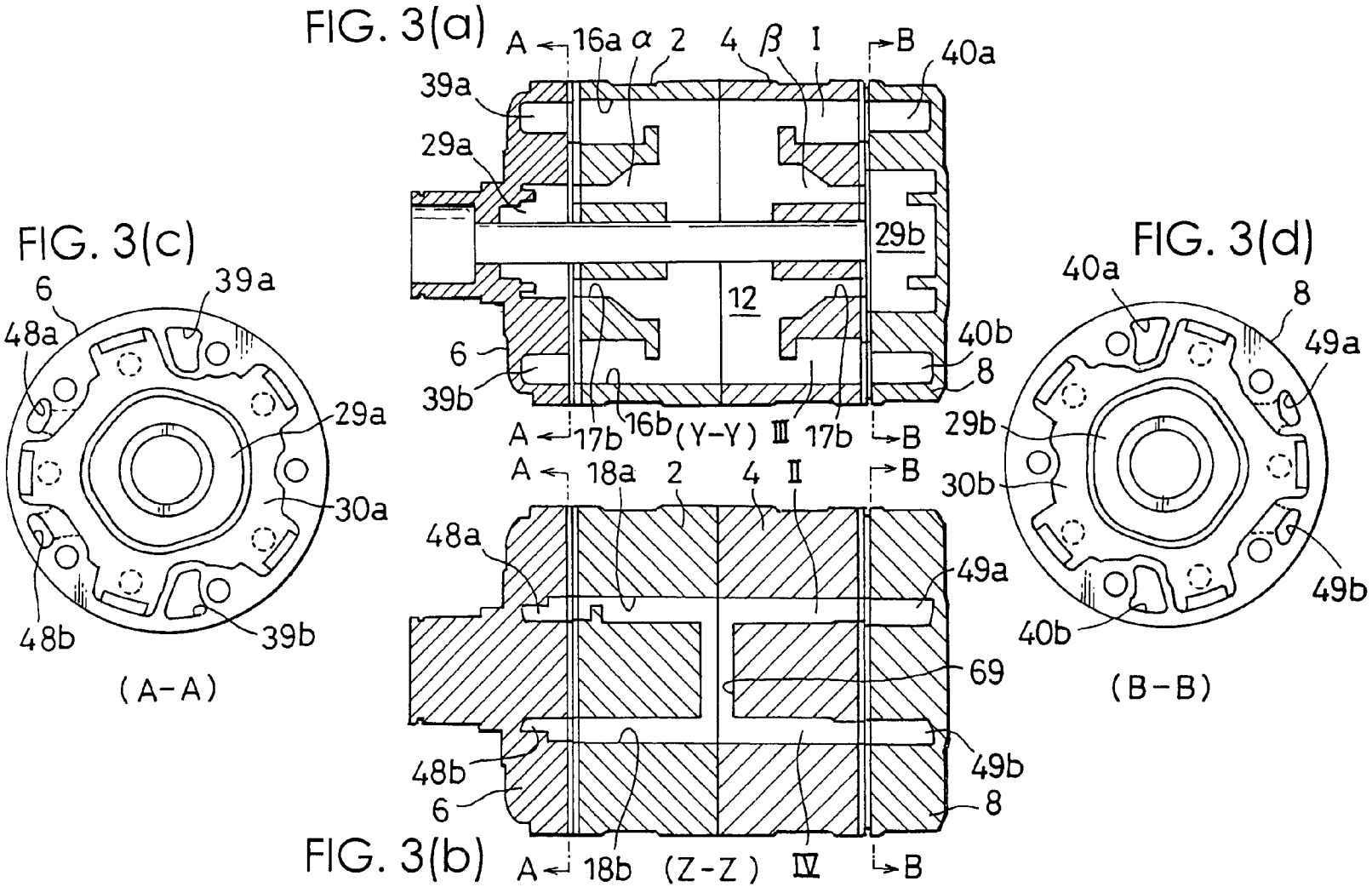
FIG. 3(*a*) is a sectional view taken along line Y-Y in FIG. 2(*b*), FIG. 3(*b*) is a sectional view taken along line Z-Z in FIG. 2(*b*), FIG. 3(*c*) shows the front-side cylinder head viewed along line A-A in FIGS. 3(*a*) and 3(*b*) and FIG. 3(*d*) shows the rear-side cylinder head viewed along line B-B in FIGS. 3(*a*) and 3(*b*)

The first gas passage (I) and the third gas passage (III) are formed substantially symmetrical relative to a plane containing the drive shaft 13, and the second gas passage and the fourth gas passage, too, are formed substantially symmetrical relative to the plane. In addition, the second gas passage (II) and the fourth gas passage (IV) are made to communicate with each other at middle areas thereof via a guide passage 69, as shown in FIG. 3.

At the housing adopting the structure described above, an external component which includes an intake port and an outlet port to be connected to piping is mounted, so that either the second gas passage (II) or the fourth gas passage (IV) is made to communicate with the front-side outlet chamber 30*a* and the rear-side outlet chamber 30*b* and that the intake port is made to communicate either with the first gas passage (I) or the third gas passage (III) with the outlet port made to communicate with either the second gas passage (II) or the fourth gas passage (IV), which is not in communication with the outlet chambers.

Namely, depending upon the specific position at which the external component is mounted at the housing, the optimal passages to communicate with the outlet chambers, the intake port and the outlet port are determined in the basic structure described earlier. More specifically, the ports are allowed to assume various positions, as shown in FIGS. 9 through 16, in conjunction with the basic structure.

The following is a detailed explanation of the individual modes with regard to the port positions. If the compressor installation location, the piping layout or the like necessitates the external component 70 to be mounted on one side at a side surface of the front-side cylinder block 2 or if it more desirable to mount the external component 70 at such a position, an intake port 71 is made to communicate with the first gas passage (I) via the front-side cylinder block 2 and the fourth gas passage (IV) is made to communicate with the front-side relay chamber 48*b* and the rear-side relay chamber 49*b*, as shown in FIG. 9. In addition, the second gas passage (II) is made to communicate with the rear-side relay chamber 49*a* and, at the same time, its communication with the front-side relay chamber 48*a* is either disallowed or allowed via an orifice. An outlet port 72 is made to communicate with the second gas passage (II) via the front-side cylinder block 2. In this mode, the relay chambers 48*b* and 49*b* at the cylinder heads 6 and 8 communicate with the outlet chamber 30*a* and 30*b*, but the relay chambers 48*a* and 49*a* are not allowed to communicate with the outlet chambers 30*a* and 30*b*.

As a result, the working fluid having flowed in through the intake port 71 located at the front-side cylinder block 2 is guided to the front-side and rear-side intake chambers 29*a* and 29*b* via the first gas passage (I), the swash plate chamber 12 and the relay gas passages α and β, is let out into the front-side outlet chamber 30*a* and the rear-side outlet chamber 30*b* after it is compressed at the compression spaces 26*a* and 26*b*, and then enters the fourth gas passage (IV) from the outlet chambers 30*a* and 30*b*. The working fluid having entered the fourth gas passage from the outlet chamber 30*a* and the working fluid having entered the fourth gas passage from the outlet chamber 30*b* join each other at a middle area of the fourth gas passage (IV), the joined working fluid is then guided to the guide passage 69 to travel from the guide passage 69 through the second gas passage (II) and flow out through the outlet port 72 located at the front-side cylinder block 2.

If, on the other hand, the external component 70 must be mounted on the other side at the side surface of the front-side cylinder block 2 or if it is more desirable to mount the external component 70 at such a location, the intake port 71 is made to communicate with the third gas passage (III) via the front-side cylinder block 2 and the second gas passage (II) is made to communicate with the front-side relay chamber 48*a* and the rear-side relay chamber 49*a*, as shown in FIG. 10. In addition, the fourth gas passage (IV) is made to communicate with the rear-side relay chamber 49*b* and, at the same time, its communication with the front-side relay chamber 48*b* is either disallowed or allowed via an orifice. The outlet port 72 is made to communicate with the fourth gas passage (IV) via the front-side cylinder block 2. In this mode, the relay chambers 48*a* and 49*a* at the cylinder heads 6 and 8 communicate with the outlet chamber 30*a* and 30*b*, but the relay chambers 48*b* and 49*b* are not allowed to communicate with the outlet chambers 30*a* and 30*b*.

As a result, the working fluid having flowed in through the intake port 71 located at the front-side cylinder block 2 is guided to the front-side and rear-side intake chambers 29*a* and 29*b* via the third gas passage (III) the swash plate chamber 12 and the relay gas passages α and β, is let out into the front-side outlet chamber 30*a* and the rear-side outlet chamber 30*b* after it is compressed at the compression spaces 26*a* and 26*b*, and then enters the second gas passage (II) from the front-side and rear-side outlet chambers 30*a* and 30*b*. The working fluid having entered the second gas passage (II) from the outlet chamber 30*a* and the working fluid having entered the second gas passage from the outlet chamber 30*b* join each other at a middle area of the second gas passage (IV), the joined working fluid is then guided to the guide passage 69 to travel from the guide passage 69 through the fourth gas passage (II) and flow out through the outlet port 72 disposed at the front-side cylinder block 2.

Next, if the external component 70 must be mounted on one side at a side surface of the rear-side cylinder block 4 or if it is more desirable to mount the external component 70 at such a location, the intake port 71 is made to communicate with the first gas passage (I) via the rear-side cylinder block 4 and the fourth gas passage (IV) is made to communicate with the front-side relay chamber 48*b* and the rear-side relay chamber 49*b*, as shown in FIG. 11. In addition, the second gas passage (II) is made to communicate with the rear-side relay chamber 49*a* and, at the same time, its communication with the front-side relay chamber 48*a* is either disallowed or allowed via an orifice. The outlet port 72 is made to communicate with the second gas passage (II) via the rear-side cylinder block 4. In this mode, the relay chambers 48*b* and 49*b* at the cylinder heads 6 and 8 communicate with the outlet chamber 30*a* and 30*b*, but the relay chambers 48*a* and 49*a* are not allowed to communicate with the outlet chambers 30*a* and 30*b*.

As a result, the working fluid having flowed in through the intake port 71 located at the rear-side cylinder block 4 is guided to the front-side and rear-side intake chambers 29*a* and 29*b* via the first gas passage (I) the swash plate chamber 12 and the relay gas passages α and β, is let out into the front-side outlet chamber 30*a* and the rear-side outlet chamber 30*b* after it is compressed at the compression spaces 26*a* and 26*b*, and then enters the fourth gas passage (IV) from the outlet chambers 30*a* and 30*b*. The working fluid having entered the fourth gas passage from the outlet chamber 30*a* and the working fluid having entered the fourth gas passage from the outlet chamber 30*b* join each other at a middle area of the fourth gas passage (IV), the joined working fluid is then guided to the guide passage 69 to travel from the guide passage 69 through the second gas passage (II) and flow out through the outlet port 72 located at the rear-side cylinder block 4.

If, on the other hand, the external component 70 must be mounted on the other side at the side surface of the rear-side cylinder block 4 or if it is more desirable to mount the external component 70 at such a location, the intake port 71 is made to communicate with the third gas passage (III) via the rear-side cylinder block 4 and the second gas passage (II) is made to communicate with the front-side relay chamber 48*a* and the rear-side relay chamber 49*a*, as shown in FIG. 12. In addition, the fourth gas passage (IV) is made to communicate with the rear-side relay chamber 49*b* and, at the same time, its communication with the front-side relay chamber 48*b* is either disallowed or allowed via an orifice. The outlet port 72 is made to communicate with the fourth gas passage (IV) via the rear-side cylinder block 4. In this mode, the relay chambers 48*a* and 49*a* at the cylinder heads 6 and 8 communicate with the outlet chamber 30*a* and 30*b*, but the relay chambers 48*b* and 49*b* are not allowed to communicate with the outlet chambers 30*a* and 30*b*.

As a result, the working fluid having flowed in through the intake port 71 located at the rear-side cylinder block 4 is guided to the front-side and rear-side intake chambers 29*a* and 29*b* via the third gas passage (III) the swash plate chamber 12 and the relay gas passages α and β, is let out into the front-side outlet chamber 30*a* and the rear-side outlet chamber 30*b* after it is compressed at the compression spaces 26*a* and 26*b*, and then enters the second gas passage (II) from the outlet chambers 30*a* and 30*b*. The working fluid having entered the second gas passage from the outlet chamber 30*a* and the working fluid having entered the second gas passage from the outlet chamber 30*b* join each other at a middle area of the second gas passage (II), the joined working fluid is then guided to the guide passage 69 to travel from the guide passage 69 through the fourth gas passage (IV) and flow out through the outlet port 72 located at the rear-side cylinder block 4.

In addition, if the external component 70 must be disposed on one side at the end surface of the rear-side cylinder head 8 or if it is more desirable to mount the external component at such a location, the intake port 71 is made to communicate with the first gas passage (I) via the rear-side cylinder head 8 and the fourth gas passage (IV) is made to communicate with the front-side relay chamber 48*b* and the rear-side relay chamber 49*b*, as shown in FIGS. 13 and 14. The second gas passage (II) is not allowed to communicate with the front-side relay chamber 48*a* altogether or is only allowed to communicate with the front-side relay chamber 48*a* via an orifice, and the outlet port 72 is made to communicate with the second gas passage via the rear-side cylinder head. In this mode, the relay chambers 48*b* and 49*b* at the cylinder heads 6 and 8 are made to communicate with the outlet chambers 30*a* and 30*b* but the relay chambers 48*a* and 49*a* are not allowed to communicate with the outlet chambers 30*a* and 30*b*.

In this case, working fluid that flows in through the intake port 71 located at the rear-side cylinder head 8 is guided to the front-side and rear-side intake chambers 29*a* and 29*b* via the first gas passage (I), the swash plate chamber 12 and the relay gas passages α and β and is let out to the front-side outlet chamber 30*a* and the rear-side of the chamber 30*b* after it is compressed at the compression spaces 26*a* and 26*b*, and then enters the fourth gas passage (IV) from the outlet chambers 30*a* and 30*b*. The working fluid having entered the fourth gas passage (IV) from the outlet chamber 30*a* and the working fluid having entered the fourth gas passage (IV) from the outlet chamber 30*b* join each other at a middle area of the fourth gas passage (IV) and the joined working fluid is then guided to the guide passage 69 to travel from the guide passage 69 through the second gas passage (II) and flow out through the outlet port 72 located at the rear-side cylinder head 8.

If the external component 70 must be mounted on the other side at the end surface of the rear-side cylinder head or if it is more desirable to mount the external component at such a location, the intake port 71 is made to communicate with the third gas passage (III) via the rear-side cylinder head 8 and the second gas passage (II) is made to communicate with the front-side relay chamber 48*a* and the rear-side relay chamber 49*a*, as shown in FIGS. 15 and 16. The fourth gas passage (IV) is not allowed to communicate with the front-side relay chamber 48*b* altogether or it is only allowed to communicate with the front-side relay chamber 48*b* via an orifice, and the outlet port 72 is made to communicate with the fourth gas passage (IV) via the rear-side cylinder head 8. In this mode, the relay chambers 48*a* and 49*a* at the cylinder heads 6 and 8 are made to communicate with the outlet chambers 30*a* and 30*b* but the relay chambers 48*b* and 49*b* are not allowed to communicate with the outlet chambers 30*a* and 30*b*.

In this case, working fluid that flows in through the intake port 71 located at the rear-side cylinder head 8 is guided to the front-side and rear-side intake chambers 29*a* and 29*b* via the third gas passage (III), the swash plate chamber 12 and the relay gas passages α and β and is let out to the front-side outlet chamber 30*a* and the rear-side outlet chamber 30*b* after it is compressed at the compression spaces 26*a* and 26*b* and then enters the second gas passage (II) from the outlet chambers 30*a* and 30*b*. The working fluid having entered the second gas passage (II) from the outlet chamber 30*a* and the working fluid having entered the second gas passage (II) from the outlet chamber 30*b* join each other at a middle area of the second gas passage (II) and the joined working fluid is then guided to the guide passage 69 to travel from the guide passage 69 through the fourth gas passage (IV) and flow out through the outlet port 72 located at the rear-side cylinder head 8.

Thus, while the intake port 71 and the outlet port 72 are made to communicate with different gas passages depending upon the installation position of the external component 70 having the intake port 71 and the outlet port 72 disposed thereat, the cylinder blocks 2 and 4, the valve plates 5 and 7, the cylinder heads 6 and 8, the valve sheets 37 and the gaskets 9 and 11 all include the passages and the passing holes necessary to constitute the first through fourth gas passages so as to allow the external component 70 to be installed at various positions. Thus, it is not necessary to modify the design of the gas passages. In other words, although the input port 71 and the outlet port 72 may be connected at different positions, the same first through fourth gas passages (I to IV) at the housing can be used, which means that universal components (the cylinder blocks 2 and 4, the valve plates 5 and 7, the valve sheets 37 and the gaskets 9 and 11) can be used to form the gas passages. As a result, a higher level of freedom is afforded with regard to the positions at which the intake port 71 and the outlet port 72 are formed. In addition, the need to form complex gas passages inside the cylinder heads is eliminated and the problem of the passages extending from the ports to the gas passages inside the housing becoming unnecessarily long is also eliminated, thereby precluding problems such as poor compressor performance, and increase in the number of machining steps that need to be performed and a complicated casting process.

INDUSTRIAL APPLICABILITY

As described above, according to the present invention, a first gas passage and a second gas passage extending along the axial direction, a third gas passage formed substantially symmetrical to the first gas passage relative to a plane containing the drive shaft, a fourth gas passage formed substantially symmetrical to the second gas passage and communicating with the second gas passage, and an external component that includes an intake port and an outlet port to be connected to pipings are disposed at a housing, either the second gas passage or the fourth gas passage is made to communicate with the front-side outlet chamber and the rear-side outlet chamber, and the intake port is made to communicate with either the first gas passage or the third gas passage and also made to communicate with the second gas passage or the fourth gas passage not in communication with the outlet chambers. Thus, even when the positions at which the intake port and the outlet port are formed need to be altered, the same housing can be used without having to modify the layout of the gas passages in the housing, which raises the level of freedom with regard to the positions at which the intake port and the outlet port are formed and allows the housing to be used in conjunction with various compressor models.

The invention claimed is:

1. A swash plate compressor, comprising:

a housing having formed therein cylinders;

a drive shaft rotatably supported at said housing;

a swash plate that is housed inside a swash plate chamber formed at said housing and rotates as one with said drive shaft; and pistons that slide reciprocally inside the cylinder bore as said swash plate rotates, wherein a front-side intake chamber and a rear-side intake chamber communicating with said swash plate chamber and disposed to the front and to the rear of said swash plate chamber along the axial direction, in which a working fluid to be guided into said cylinders is stored, a front-side outlet chamber and a rear-side outlet chamber disposed to the front and to the rear of said swash plate chamber along the axial direction, in which the working fluid having been compressed by said pistons is stored, a first gas passage and a second gas passage extending along the axial direction, a third gas passage formed substantially symmetrical to said first gas passage relative to a plane containing said drive shaft, a fourth gas passage formed substantially symmetrical to said second gas passage relative to the plane containing said drive shaft and communicating with said second gas passage and an external component that includes an intake port and an outlet port to be connected to piping, are all disposed at said housing;

wherein said first gas passage and said third gas passage communicate with said swash plate chamber;

wherein said first gas passage and said third gas passage are operative to communicate with said intake port to supply the working fluid into said front-side intake chamber and said rear-side intake chamber; and wherein either said second gas passage or said fourth gas passage is made to communicate with said front-side outlet chamber and said rear-side outlet chamber and said second gas passage or said fourth gas passage, which is not in communication with said outlet chambers, is made to communicate with said outlet port.

2. A swash plate compressor according to claim 1, wherein said first gas passage and said third gas passage communicate with said swash plate chamber and a front-side relay gas passage and a rear-side relay gas passage are also formed at said housing to communicate between said swash plate chamber and said front-side intake chamber and between said swash plate chamber and said rear-side intake chamber.

3. A swash plate compressor according to claim 1, wherein said housing is constituted with a cylinder block having formed therein said cylinders, a valve plate having formed therein an intake hole and an outlet hole in correspondence to each of said cylinders and a cylinder head fixed to said cylinder block via said valve plate, which forms an intake chamber that is allowed to communicate with said intake hole and an outlet chamber that is allowed to communicate with said outlet hole; and wherein said valve plate constitutes part of components forming said first through fourth gas passages.

4. A swash plate compressor according to claim 3, wherein a valve sheet having formed therein an intake valve is disposed between said cylinder block and said valve plate; and wherein said valve sheet constitutes part of components forming said first through fourth gas passages.

5. A swash plate compressor according to claim 3, wherein said cylinder head constitutes part of components forming said first through fourth gas passages.

6. A swash plate compressor according to claim 3, wherein said cylinder block constitutes part of components forming said first through fourth gas passages.

7. A swash plate compressor according to claim 1, wherein at least one of components forming said first through fourth gas passages is used commonly on a front-side and a rear-side.

8. A swash plate compressor according to claim 1, wherein said first gas passage or said third gas passage to communicate with said intake port and said second gas passage or said fourth gas passage to communicate with said outlet port can be selected depending upon positions assumed by said intake port and said outlet port.

* * * * *